US007301111B2

(12) United States Patent
Kondo et al.

(10) Patent No.: US 7,301,111 B2
(45) Date of Patent: Nov. 27, 2007

(54) SLIDE SWITCH

(75) Inventors: Hayato Kondo, Yao (JP); Takayuki Nagata, Yao (JP); Akihito Shichida, Yao (JP); Akira Yamamoto, Yao (JP)

(73) Assignee: Hosiden Corporation, Osaka (JP)

( * ) Notice: Subject to any disclaimer, the term of this patent is extended or adjusted under 35 U.S.C. 154(b) by 0 days.

(21) Appl. No.: 11/589,032

(22) Filed: Oct. 27, 2006

(65) Prior Publication Data

US 2007/0095635 A1 May 3, 2007

(30) Foreign Application Priority Data

Nov. 2, 2005 (JP) ..... 2005-320014

(51) Int. Cl.
*H01H 9/00* (2006.01)

(52) U.S. Cl. ..... 200/4; 200/5 R; 200/534; 345/161

(58) Field of Classification Search ..... 200/4, 200/5 R, 6 A, 16 C, 537, 541, 18; 345/161, 345/156; 273/148 B
See application file for complete search history.

(56) References Cited

U.S. PATENT DOCUMENTS 6,657,141 B1 * 12/2003 Myojin ..... 200/6 A
6,689,967 B2 * 2/2004 Myojin ..... 200/18
6,791,037 B1 * 9/2004 Ling ..... 200/4
6,906,269 B2 6/2005 Nishimura et al.

FOREIGN PATENT DOCUMENTS

| | | |
|---|---|---|
| JP | 7262878 | 10/1995 |
| JP | 9245577 | 9/1997 |
| JP | 10302576 | 11/1998 |
| JP | 2002260489 | 9/2002 |
| JP | 2002260490 | 9/2002 |
| JP | 2003031076 | 1/2003 |
| JP | 2003050667 | 2/2003 |
| JP | 2004171924 | 6/2004 |

* cited by examiner

*Primary Examiner*—K. Richard Lee
(74) *Attorney, Agent, or Firm*—The Webb Law Firm

(57) ABSTRACT

A slide switch includes an operational member slidable in a direction along a virtual plane, a plurality of movable contacts arranged surrounding the operational member, a plurality of fixed contacts provided in correspondence with the movable contacts to render at least one of the movable contacts into a conductive state when the operational member is operated, a support member for slidably supporting the operational member via a sliding face provided on the back face of the operational member, a guide mechanism which allows integral displacement of the operational member and the support member in response to a depressing operation of the operational member in a normal direction and an urging mechanism operable to return the support member in the absence of the depressing operation.

7 Claims, 13 Drawing Sheets

SLIDE SWITCH

BACKGROUND OF THE INVENTION

1. Field of the Invention

The present invention relates to a slide switch having an operational member slidable in a direction along a virtual plane, a plurality of movable contacts arranged at positions surrounding the operational member and a plurality of fixed contacts provided in correspondence with the movable contacts so as to render at least one of the movable contacts into a conductive state in association with a sliding operation of the operational member.

2. Description of the Related Art

Techniques relating to a slide switch having the above-described construction are known from Patent Document 1 and Patent Document 2 identified below.

Patent Document 1: Japanese Patent Application "Kokai" No. 7-262878

Patent Document 2: Japanese Patent Application "Kokai" No. 2003-31076

With the switch disclosed in Patent Document 1, a contact switching shaft of an operational button (corresponding to "operational member" of the present invention) is inserted into a cross-shaped aperture defined in an operational button guide panel, and at positions surrounding this switching shaft, there are disposed four first contacts (corresponding to "movable contacts" of the present invention) and corresponding second contacts (also corresponding to "movable contacts" of the present invention). In this switch, as the four first contacts cooperate to exert an elastic urging force to clamp the switching shaft, the operational button is urged toward its neutral position. When a user operates the operational button, the contact switching shaft is pressed against a first contact corresponding to the operated direction, so that this first contact is placed into contact with the second contact, thereby obtaining a conductive state.

With the switch disclosed in Patent Document 2, inside a main case, there is disposed an urging member formed of elastomer and having four projections. At the center portion of this urging member, there is embedded a sliding member, to which an operational button is operably connected. In this switch, four conductive members (corresponding to the "movable contacts" of the present invention) are provided in the outer periphery of the urging member and electrodes (corresponding to the "fixed contacts" of the present invention) are provided in the inner wall of the main case at positions thereof corresponding to the conductive members. Under an un-operated state, the operational button is urged to its neutral position by the urging force from the urging member. When the operational button is operated, the conductive member is contacted therewith to render an electrode into a conductive state.

Further, with this switch, a slider is fitted on the opposite side to the operational button and a movable contact is disposed at a position contactable with this slider. And, a fixed contact is disposed at a position corresponding to this movable contact. The movable contact has a center portion projecting toward the slider. When the operational button is operated in a depressing direction, the movable contact is elastically deformed to come into contact with the fixed contact, thus establishing electric conduction.

With this type of slide switch, a good operational feel can be obtained if the operational member thereof can be slid smoothly under a stable posture. And, such good operational feel should be maintained also in the case of the operational member being operated by its depression, as described in Patent Document 2.

However, in the case of the switch disclosed in Patent Document 1, when the operational button is slid, this operational button comes into contact with the operational button guide panel, so that the button can be operated smoothly. On the other hand, however, as the operational button guide panel is exposed to the outside, such smooth operation can be impaired if dust or the like enters the panel.

Further, in the case of the switch disclosed in Patent Document 2, the sliding member is engaged with the slider which effects a sliding operation in directions normal to each other. Hence, during a sliding operation, the sliding operations need to take place at a plurality of contact faces, so that this fact may impair the smooth sliding operation.

SUMMARY OF THE INVENTION

In view of the above, a primary object of the present invention is to provide a slide switch with a rationalized construction which ensures not only a smooth operation in a sliding direction, but also a depressing operation in a direction normal to the sliding direction.

For accomplishing the above-noted object, according to the present invention, there is proposed a slide switch comprising:

an operational member slidable in a direction along a virtual plane;

a plurality of movable contacts arranged at positions surrounding the operational member;

a plurality of fixed contacts provided in correspondence with the movable contacts so as to render at least one of the movable contacts into a conductive state in association with a sliding operation of the operational member;

a support member for slidably supporting said operational member via a sliding face provided on the back face of the operational member;

a guide mechanism which allows integral displacement of said operational member and said support member in response to a depressing operational force to said operational member in a direction normal to said virtual plane; and an urging mechanism operable to return said support member toward said operational member in the absence of said depressing operational force.

With the inventive slide switch having the above-described construction, when the operational member is operated along the virtual plane, the operational member is guided by the support member with the sliding face of the operational member contacting the support member, so that the operational member can be operated smoothly. Whereas, when the operational member is not operated, the operational member is retained at the neutral position by the urging force exerted from the plurality of movable contacts.

Moreover, the contacting portion between the operational member and the support member is located at a position not exposed to the outside, namely, at the position corresponding to the back face of the operational member. Therefore, undesirable intrusion of dust or the like from the outside can be restricted, thus maintaining smooth operational condition.

Further, when the operational member is depressed in the direction normal to the virtual plane, the operational member and the support member are operated together in the depressing operation direction by the guide mechanism. When this depressing operation is not effected, they are maintained at the predetermined returned positions by the urging mechanism. Consequently, there has been provided a slide switch with a rationalized construction which ensures not only a smooth operation in a sliding direction, but also a depressing operation in a direction normal to the sliding direction.

According to a further feature of the present invention, said guide mechanism includes a retaining member for electrically integrating and retaining the plurality of fixed contacts, and said retaining member includes, at an opposite end thereof away from the operational member, a contacting piece for coming into contact with said support member for applying an urging force thereof, said contacting piece constituting said urging mechanism.

With the above-described construction, as the plurality of fixed contacts are retained to the retaining member, during an assembling operation of the switch, the setting operation of the plurality of fixed contacts is made easier and it becomes also possible to render the plurality of fixed contacts into the conductive state thereof, thus forming a common electrode. Further, as this retaining member acts also as the guide mechanism for allowing integral displacement of said operational member and said support member, the number of the components together constituting the switch can be reduced advantageously. In addition, as the contacting piece formed in the retaining member is used as the urging mechanism, there is no need of separately providing a spring.

According to a still further feature of the present invention, there is provided an operation detecting mechanism which reaches a detecting condition in response to a pressure applied from said support member in the course of the depressing operation of said operational member, and a gap is formed between said support member and said operation detecting mechanism in the absence of the depressing operation of the operational member.

With the above-described construction, the operation of the operational member in the depressing direction can be detected by the operation detecting mechanism. Further, as a gap is formed between mutually opposing faces of the support member and the operation detecting mechanism, in the absence of the depressing operation of the operational member, the operation detecting mechanism can be reliably maintained under the non-operated state, so that an erroneous detection can be avoided.

According to a still further feature of the present invention, said operation detecting mechanism includes a conductive spring plate portion and a plurality of electrode portions which come into contact with said spring plate portion in accordance with a deformation amount corresponding to the pressure from said support member.

With the above-described construction, when pressure is applied from the support member, the spring plate portion is deformed by an amount corresponding to the magnitude of this pressure, and according to this deformation amount, the spring plate portion comes into contact with one of the plurality of electrode portions. As a result, a pressure acting on an operational member can be measured electrically.

According to a still further feature of the present invention, there is provided a case member for slidably accommodating said operational member therein, and said movable contact includes a base end portion supported to said case member and a contacting portion in the form of a plate spring disposed in opposition to said fixed contact.

With the above-described construction, the operational member can be maintained at the neutral position by utilizing an elastic resilient force of the plate spring.

According to a still further feature of the present invention, a coil spring portion is formed between said base end portion and said contacting portion.

With this construction, the operational member can be maintained at the neutral position by utilizing an elastic resilient force of the coil spring portion. Further, even if the movable contact is adapted to be deformed largely, the above construction can restrict reduction in the elastic resilient force, and the durability is improved also.

According to a still further feature of the present invention, for each said movable contact, there are provided a plurality of said fixed contacts electrically insulated from each other, and in accordance with increase in the sliding operation amount of said operational member, there occurs corresponding increase in the number of the fixed contacts which come into contact with the movable contact.

With the above-described construction, when the operational member is operated in the sliding direction, the movable contact comes into contact with a number of fixed contacts corresponding to the strength or magnitude of this operational force. Hence, it becomes possible to electrically detect the force of the operation operating the operational member in the sliding direction or the operation amount of the sliding operation.

DESCRIPTION OF THE PREFERRED EMBODIMENTS

Next, preferred embodiments of the present invention will be described in details with reference to the accompanying drawings.

As shown in FIGS. 1 through 4, a slide switch of the invention includes a ring-like case 1 which is open in its upper and lower sides. Within this case 1, there are accommodated a disc-like operational button 2 (an example of the "operational member") and a disc-like support member 3 in superposition with each other.

Figure 2:
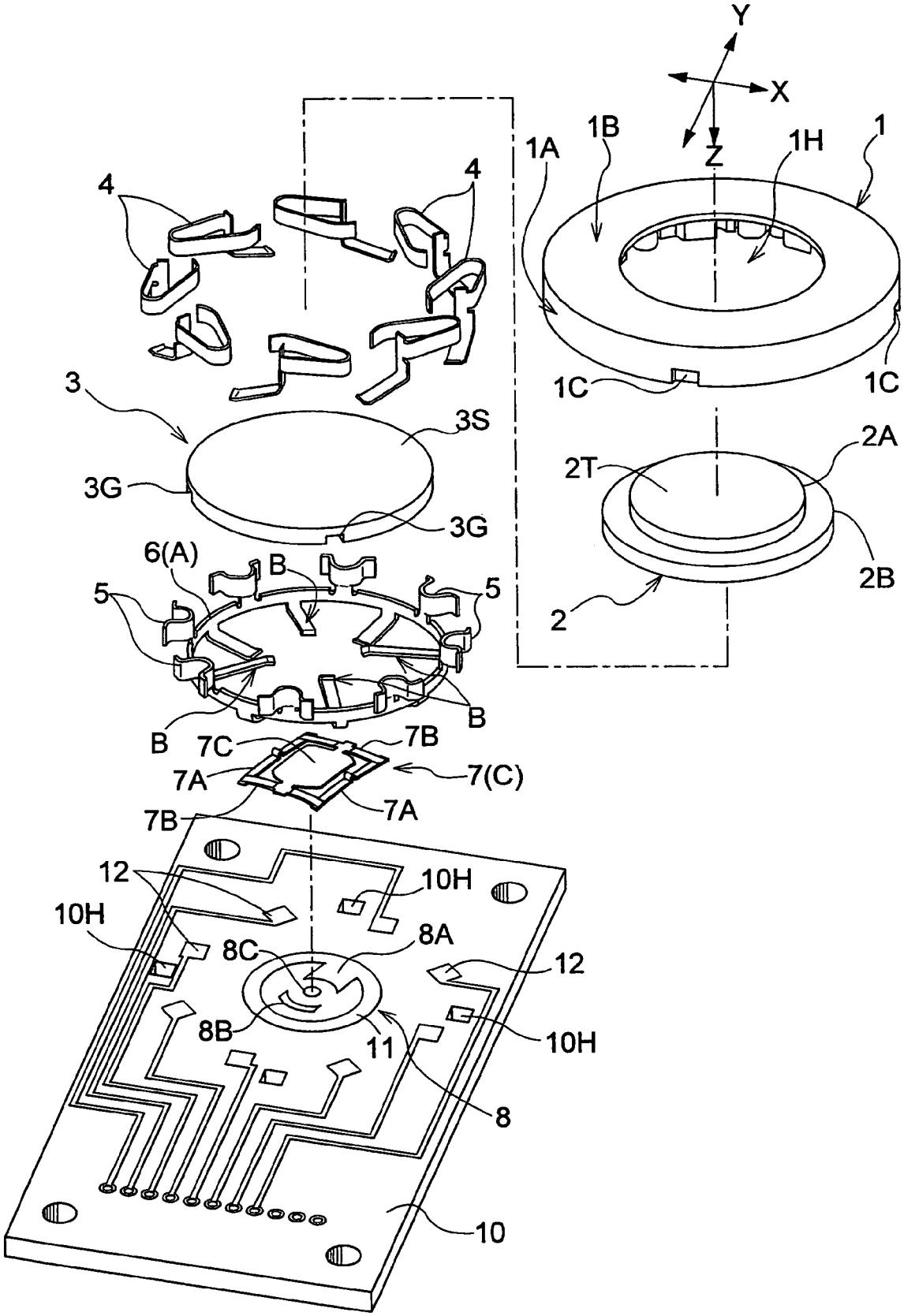
FIG. 2 is a perspective view showing the printed circuit board and the slide switch under exploded conditions thereof.
Figure 3:
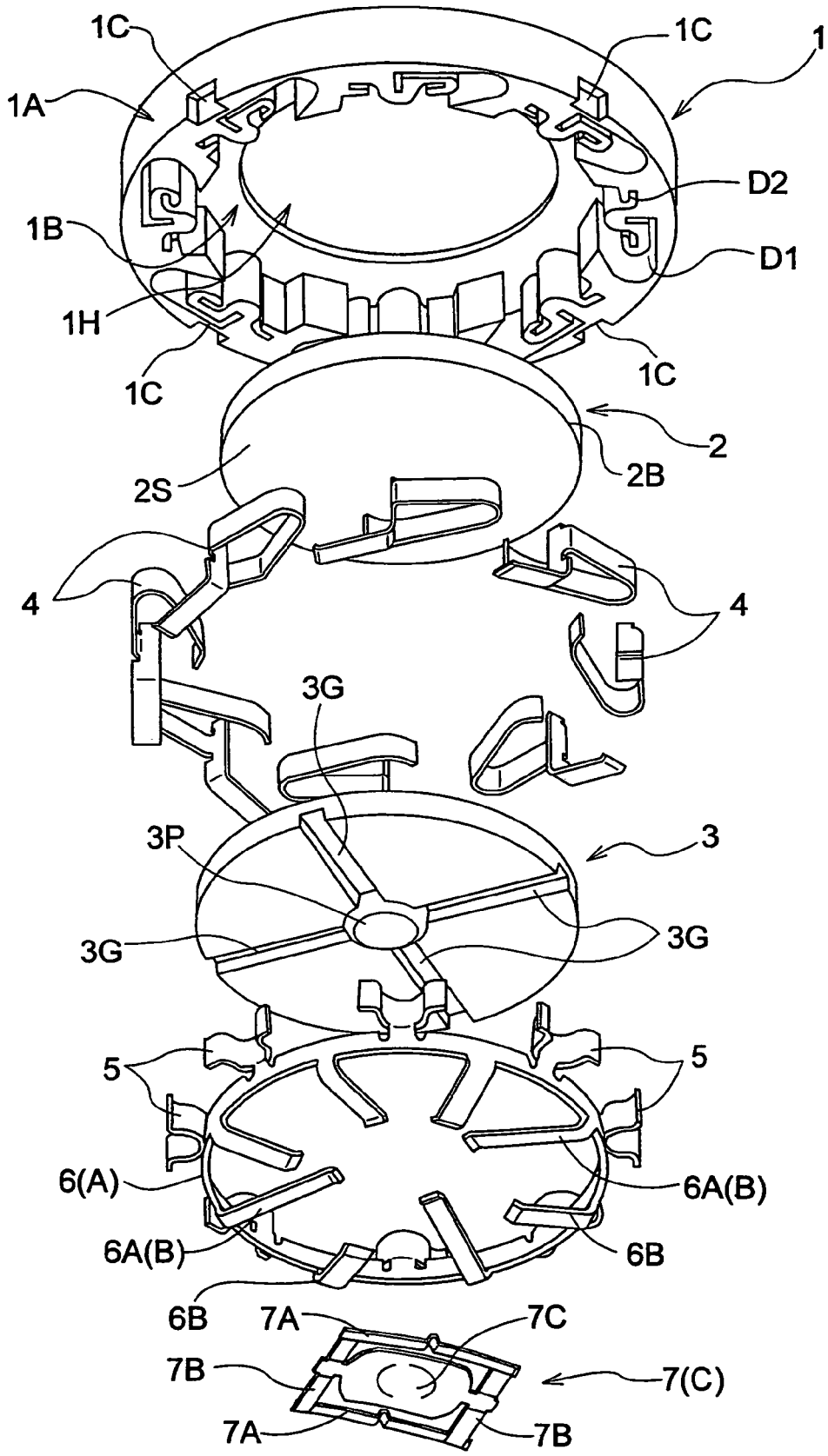
FIG. 3 is an exploded perspective view of the slide switch.

As shown in FIG. 2 and FIG. 3, at positions surrounding the operational button 2, there re provided eight movable contacts 4, and eight fixed contacts 5 are disposed at positions corresponding to the eight movable contacts 4.

The slide switch further includes a guide mechanism A which allows integral displacement of the operational button 2 and the support member 3 in response to a depressing operation of the operational button 2 downwards (the direction of axis X in FIG. 2), an urging mechanism B for pushing back the support member 3 upwards, and an operation detecting mechanism C which reaches a detecting condition in response to a pressure applied from the support member 3 when the operational button 2 is depressed.

With this side switch, the operational button 2 can be slidably operated along a virtual plane (not shown) formed by an X axis and a Y axis shown in FIG. 2 and extending normal to each other. The operational button 2 can be depressed in a direction of Z extending normal to the virtual plane.

Incidentally, this slide switch can be used in either under upward orientation or downward orientation. For the sake of convenience of explanation, the switch will be described under the upward orientation which is upward along the Z direction shown in FIGS. 1 and 2.

This slide switch can be used in a mobile phone, a PDA, a controller of a game machine, a remote controller of a home electronic appliance, etc.

Under the mounted condition of this slide switch, the operation detecting mechanism C is mounted on a printed circuit board (PCB) 10, and the case 1 accommodating the operational button 2, the support member 3, etc. is also mounted on the PCB 10 at a position covering the operation detecting mechanism C. Instead, the operation detecting mechanism C can be retained to the case 1.

Figure 8:
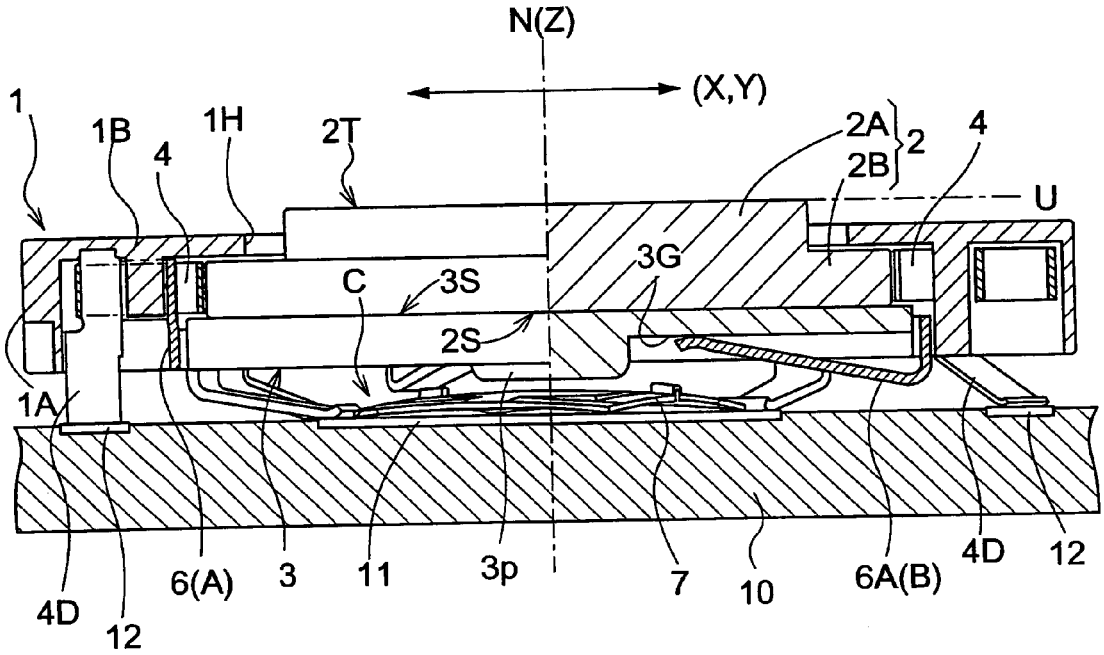
FIG. 8 is a section view of the slide switch under a non-operated state and a depressed state thereof.
Figure 8:
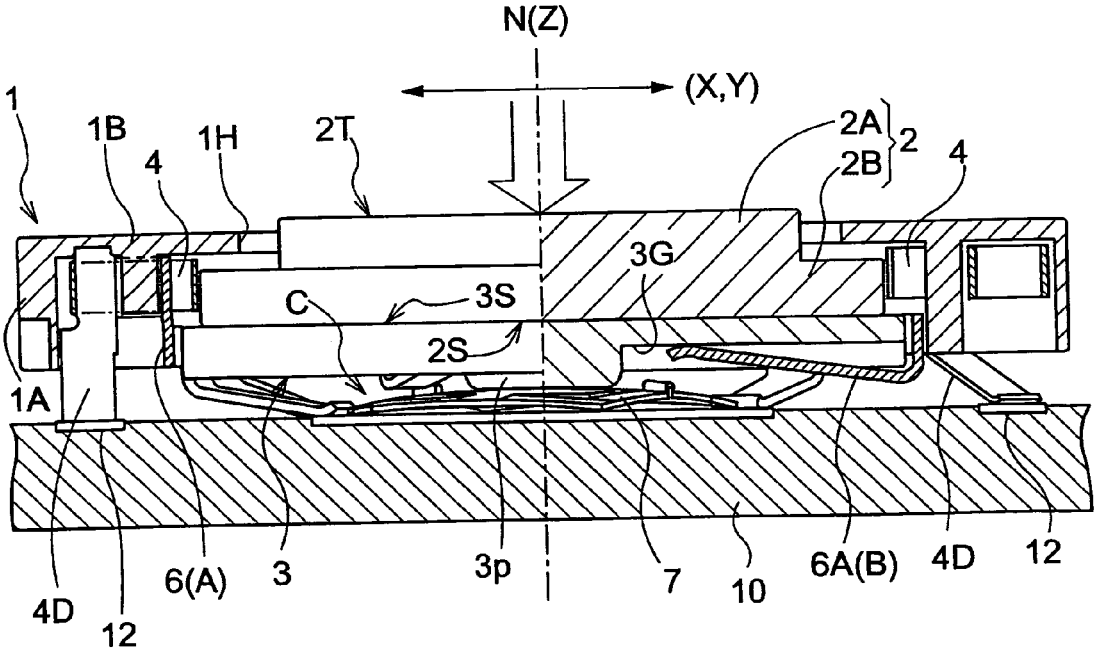

With this slide switch, as shown in FIG. 8, under its non-operated state, the operational button 2 is retained at a neutral position N in the virtual plane, by urging forces applied from the eight movable contacts 4. Similarly, under the non-operated state, the operational button 2 is retained at a non-operated position U on the Z axis by the urging force from the urging mechanism B.

The case 1 is formed of an electrically insulating material such as a plastic. As shown in FIGS. 2 and 3, the case 1 includes a side wall 1A and an upper wall 1B and a plurality of positioning recesses 1C are defined in the outer face of the side wall 1A adjacent the bottom of the case. The upper wall 1B defines a circular opening 1H. At the bottom side of this case 1, there are formed eight first engaging grooves D1 for fitting the movable contacts 4 therein and eight second engaging grooves D2 for fitting the fixed contacts 5 therein.

The operational button 2 is also formed of an electrically insulating material. As shown in FIG. 2, this button 2 is a structure integrally forming a projecting portion 2A having a smaller diameter than the opening 1H of the case 1 and a flange portion 2B having a larger diameter than the opening 1H of the case 1. On the top side of the projecting portion 2A, there is formed an operational face 2T to be contacted by a user's finger and on the bottom side of the flange portion 2B, there is formed a sliding face 2S.

The support member 3 is larger in its diameter than the flange portion 2B and on the top side thereof, there is formed a smooth supporting face 3S for coming into contact with the sliding face of the operational button 2. The support member 3 further includes four engaging grooves 3G extending radially.

The sliding operation of the operational button 2 takes place with the sliding face 2S provided at the bottom side of the operational button 2 contacting the supporting face 3S provided on the top side of the support member 3. For this reason, in this particular embodiment, the supporting face 3S and the sliding face 2S are finished as smooth faces. Instead, a smooth sliding operation will be possible also by forming a number of small projections with a same height in one of these faces so as to avoid their mutual sticking under the atmospheric pressure.

Figure 5:
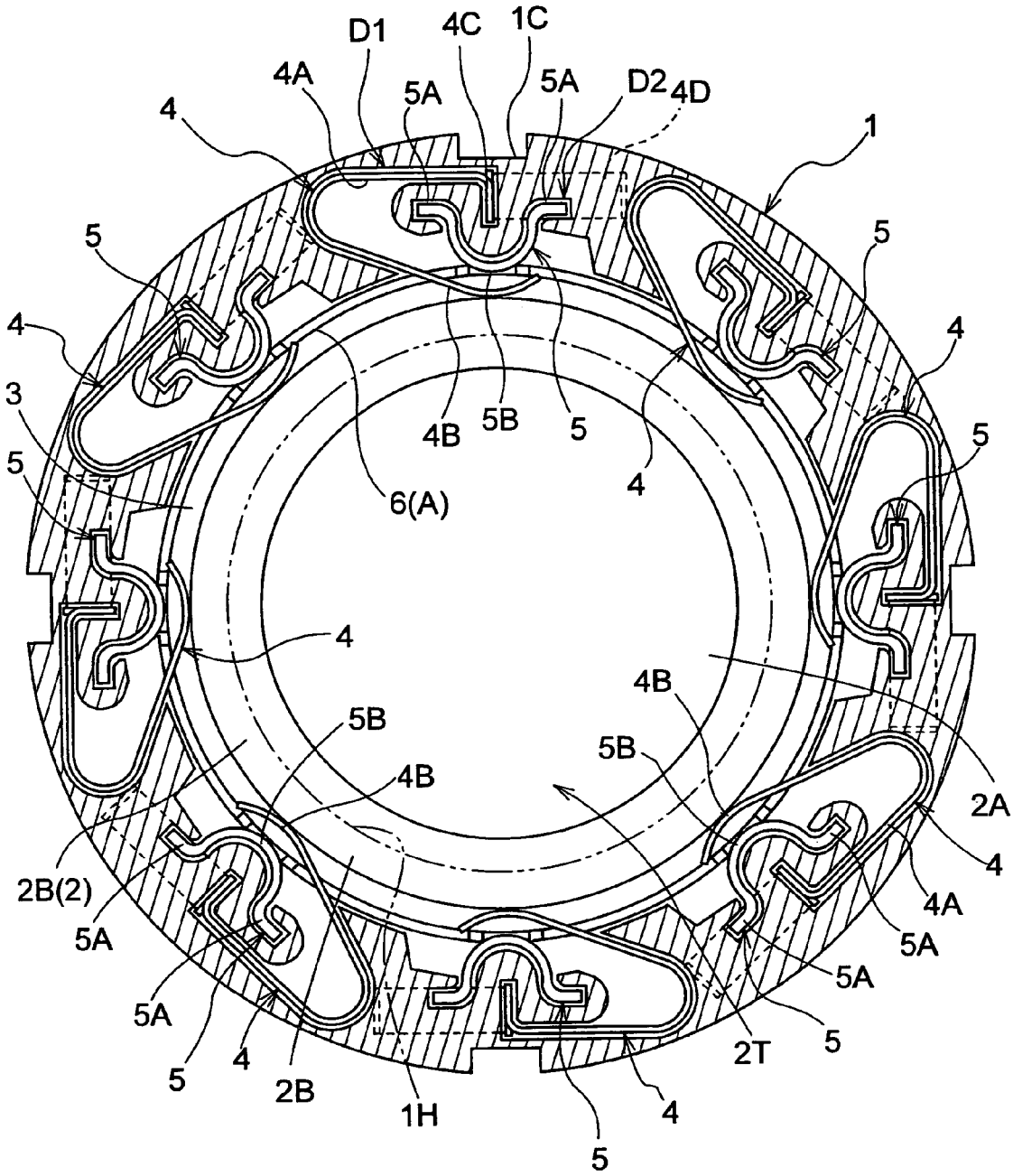
FIG. 5 is a plan view in section of the slide switch.
Figure 6:
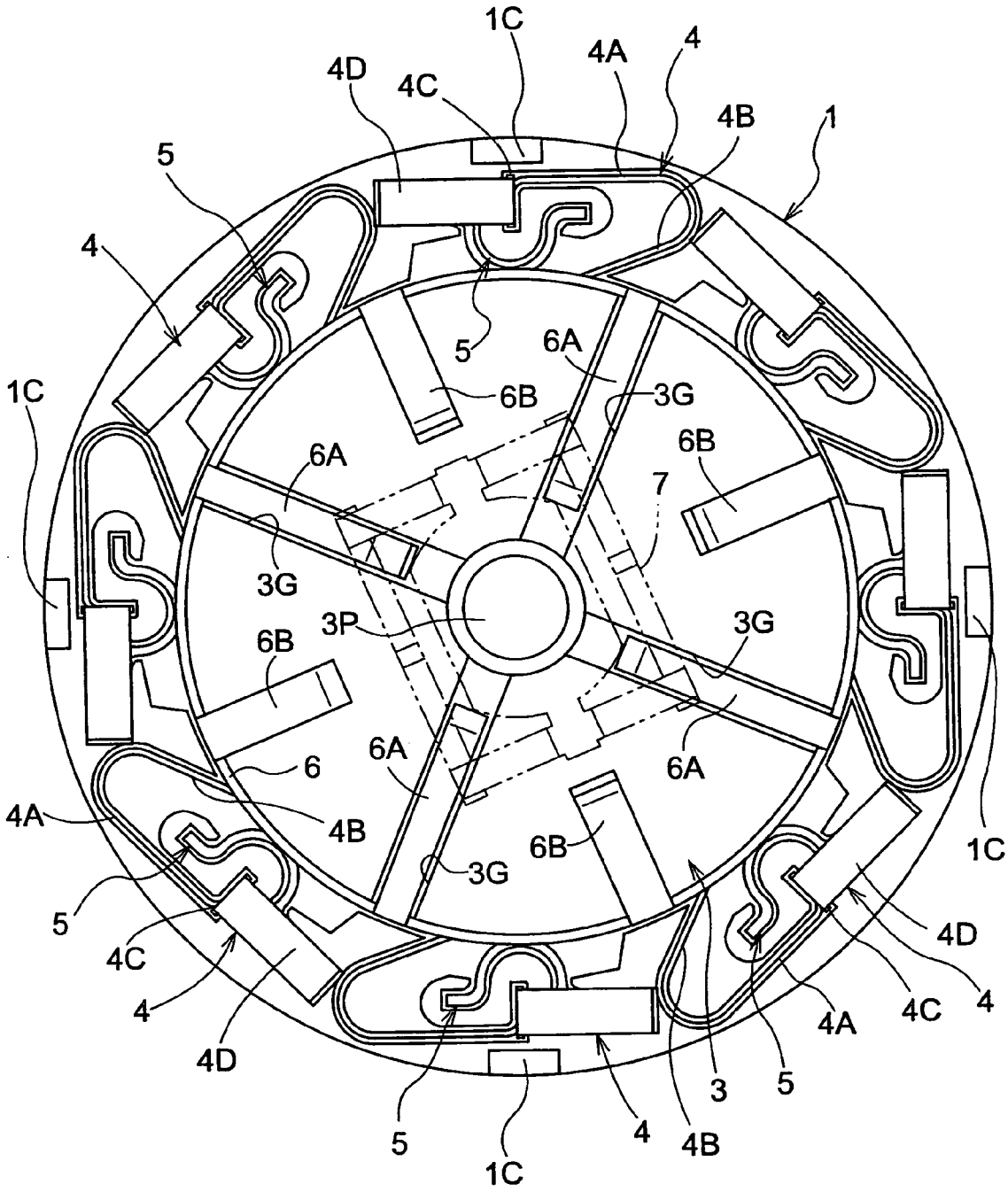
FIG. 6 is a bottom view of the slide switch.
Figure 7:
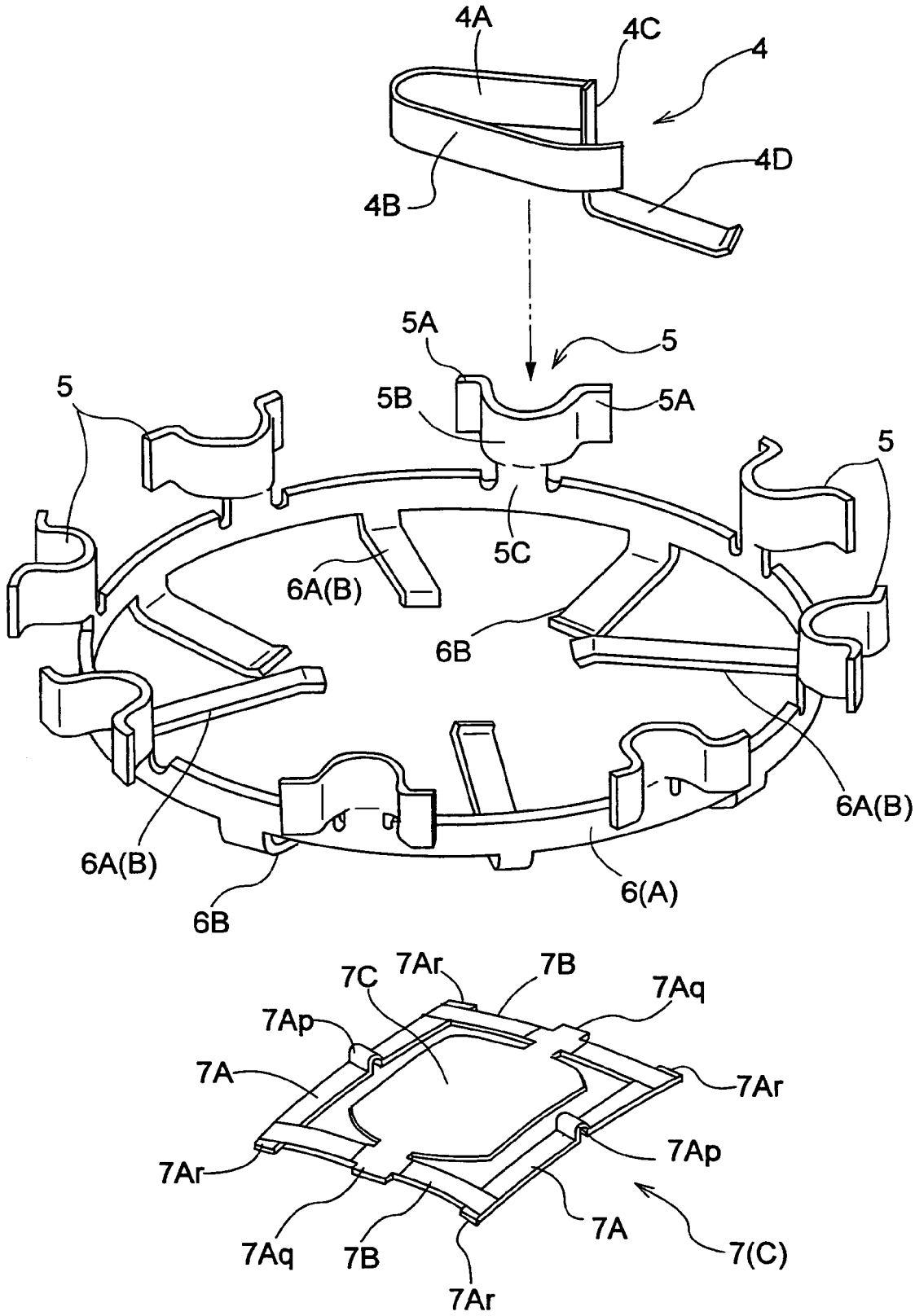
FIG. 7 is a perspective view showing general construction among movable contacts, fixed contacts and an elastic contact.

The movable contact 4 is formed by forming a spring plate member made of a readily elastically deformable copper alloy into the shape illustrated in FIGS. 5-7. Each movable contact 4 includes a base end portion 4A to be fitted into the first engaging groove D1 of the case 1, a contacting portion 4B extending with a curve from one end of the base end portion 4A so as to oppose an outer peripheral portion of the flange portion 2B of the operational button 2, a vertical frame portion 4C extending continuously at a right angle from the other end of the base end portion 4A and an electrode portion 4D projecting obliquely downward from the lower end of the vertical frame portion 4C.

When the eight movable contacts 4 are attached to the case 4, each contacting portion 4B comes into contact with a light pressure to the outer peripheral face of the flange portion 2B of the operational button 2. Therefore, when the operational button 2 is free from any operational force in the sliding direction, the operational button 2 is retained at the neutral position N by the urging forces from the eight movable contacts 4.

Each one of the fixed contacts 5 provided in correspondence with the movable contacts 4 described above includes a contacting portion 5B which has an arcuate shape in its plan view, and a pair of fixing portions 5A provided at the opposed ends of the contacting portion 5B. Total eight fixed contacts 5 are retained to an annular retaining member 6 made of a copper alloy via respective connecting portions 5C extending from a portion of the contacting portions 5B. And, these eight fixed contacts 5 and the one annular retaining member 6 are formed integral with each other by punching and bending a plate-like blank made of the copper alloy. As the eight fixed contacts and the single retaining member 6 are formed integral with each other as described above, this retaining member 6 is used as a common electrode.

The retaining member 6 need not necessarily of such circular annular shape, but may be of other annular shape of a polygon such as an octagon, a hexadecagon, etc. Or, this retaining member 6 can be of an incomplete annular shape having a discontinuity or slit therein. Further alternatively, if the function of the guide mechanism A to be described later is not needed, this retaining member 6 can be a thin plate-like member or a disc-like plate member having holes or a polygonal plate member having holes, therein, etc.

The fixing portion 5A of the fixed contact 5 is fitted within the second engaging groove D2 of the case 1. In association with a sliding operation of the operational button 2, the contacting portion 4B of the movable contact 4 is elastically deformed by the pressing force from the operational button 2 to come into contact with the contacting portion 5B.

As the eight fixed contacts 5 are supported to the case 1 via the engaging grooves D2 as described above, the retaining member 6 is retained adjacent the inner periphery of the case 1. And, as the support member 3 is inserted into the interior of the retaining member 6 to be movable along the axis Z, this retaining member 6 acts as the guide mechanism A for the support member 6.

The fixed contact 5 is rendered into a conductive state thereof when the contacting portion 4B of the movable contact 4 comes into contact with the contacting portion 5B. In this respect, at the time of contacting between the respective contacting portions 5B, 4B, the contacting portion 5B of the fixed contact 5 is moved with friction relative to the contacting portion 4*b* of the movable contact 4, thus providing a wiping effect for removing oxides, dust or the like present on the surfaces thereof. Namely, in order to realize such wiping effect, the fixed contacts 5 are supported to the case 1 in such a manner that during the contact between the contacting portions 4B, 5B, there occurs not only the elastic deformation of the contacting portion 4B of the movable contact 4, but also slight deformation of the contacting portion 5B of the fixed contact 5.

At the bottom of the retaining member 6, there are formed four contacting pieces 6A for engaging into the engaging grooves 3G of the support member 3 thus upwardly urging the support member 3, and four contacting points 6B projecting obliquely downward from the retaining member 6. The four contacting pieces 6 function as the urging mechanism B. And, as the urging force from this urging mechanism B is applied to the operational button 2 via the support member 3, the flange portion 2B of the operational button 2 comes into contact with the inner face of the upper wall 1B of the case 1, thus being retained at the non-operated position U.

As described hereinbefore, the fixed contacts 5 and the retaining member 6 are formed integral with each other and the contacting pieces 6A formed in the retaining member 6 need to be elastically deformed easily. For this reason, in forming the fixed contacts 5 and the retaining member 6 integrally, it will be reasonable to effect this by working the readily elastically deformable pipe material or pressing a readily elastically deformable plate material. However, it may be also possible to prepare these eight fixed contacts 5 and the retaining member 6 as separate elements and then connecting these separate elements for obtaining a structurally and electrically integral structure.

The operation detecting mechanism C, as shown in FIG. 2, consists essentially of an elastic contact 7 supported to the PCB 10 and a fixed electrode 8 formed in the PCB 10, so that the mechanism functions as a push-on type switch. More particularly, the elastic contact 7 consists of a rectangular frame portion 7A made of a readily elastically deformable copper alloy, and a readily elastically deformable curved spring plate portion 7C connected structurally and electrically to this frame portion 7A via a pair of connecting portions 7B and disposed within the frame portion 7A.

In the rectangular frame portion 7A, two sides of total four sides thereof are formed longer than the other two sides and at a center portion of each short side, there is formed a projecting piece 7Aq projecting upward. And, at four corners thereof, there are formed projecting portions 7Ar bulging outward along the long sides. Incidentally, the spring plate portion 7C constituting the elastic contact 7 need not necessarily be of such curved shape as described above. Instead, this portion 7C can be adapted such that it maintains a flat shape under the non-operated state and becomes bent under the operated state.

This elastic contact 7 is made by forming the frame portion 7A, the connecting portions 7B and the spring plate portion 7C integrally with each other by pressing the elastically readily deformable copper alloy plate. And, the elastic contact 7 is formed such that the center portion of the spring plate portion 7C is formed with a curve bulging gently upward and also the center portion of the entire contact bulges upward. With such shaping arrangement, when the elastic contact 7 is mounted on the PCB 10 and is not subjected to any external force, only the four projecting portions 7Ar and the two projecting pieces 7Aq contact the PCB 10. Incidentally, the elastic contact 7 may be formed by interconnecting a plurality of separate elements by such technique as the spot welding.

Figure 4:
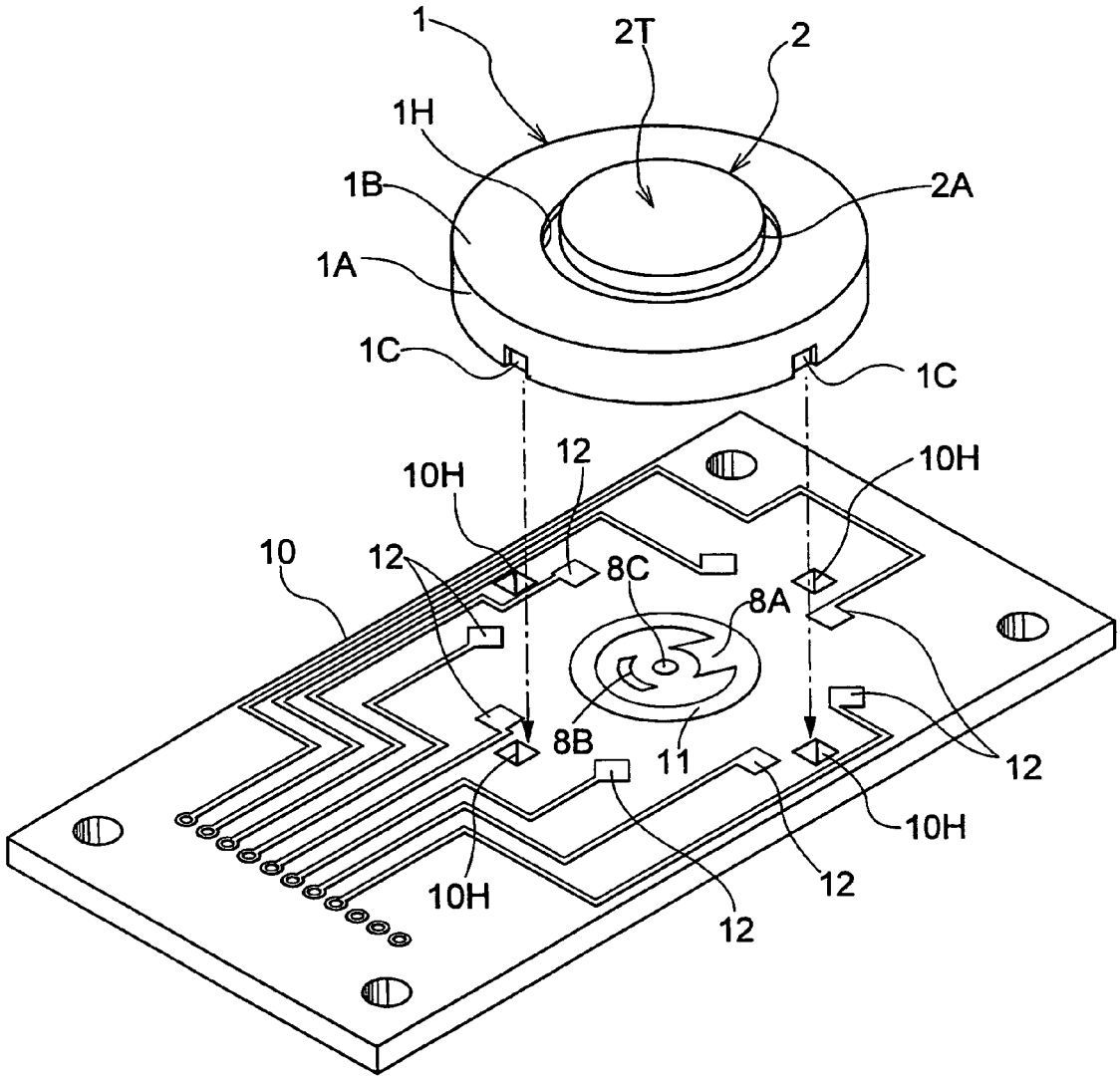
FIG. 4 is a perspective view showing the slide switch when detached from the printed circuit board.

The fixed electrode 8, as shown in FIG. 2 and FIG. 4, includes a first electrode portion 8A, a second electrode portion 8B and a third electrode portion 8C which are formed by the circuit printing technique. And, a ring-like electrode portion 11 is disposed so as to surround the first electrode portion 8A, the second electrode portion 8B and the third electrode portion 8C. And, this ring-like electrode portion 11 is formed to be electrically conductive with the first electrode portion 8A. Further, the ring-like electrode portion 11 is positioned also to become electrically connected with the contacting points 6B formed in the retaining member 6 when the case 1 is finally attached.

The first electrode portion 8A and the second electrode portion 8B are disposed such as to be downwardly away from the connecting portions 7B. Though not shown, the PCB 10 includes a circuit for obtaining potential differences between the first electrode portion 8A, the second electrode portion 8B and the third electrode portion 8C.

Figure 10:
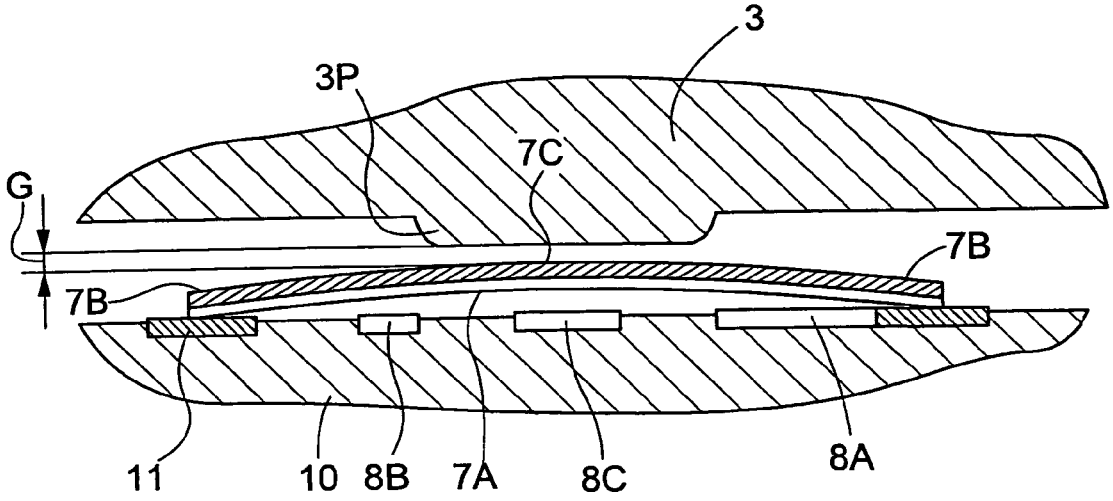
FIG. 10 is a section illustrating operational modes of the elastic contact in its depressing operation.
Figure 10:
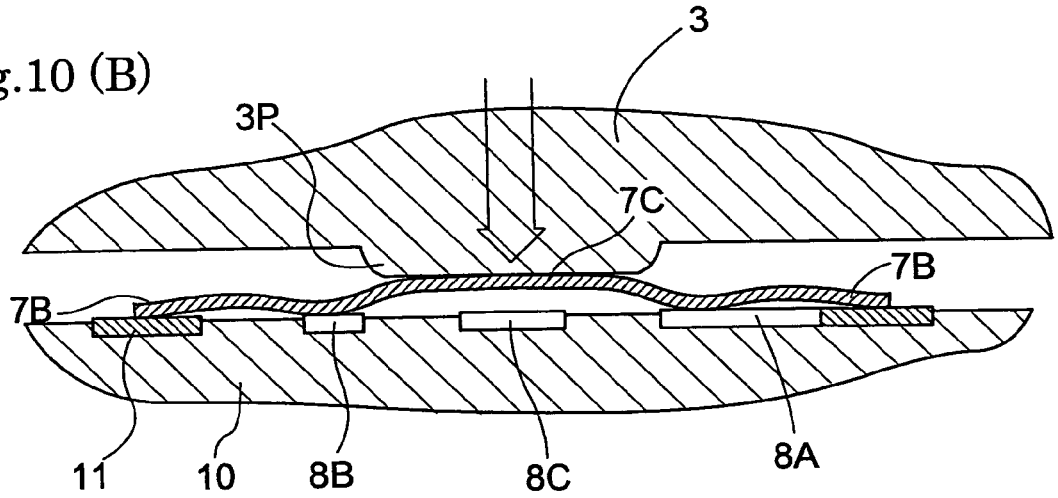
Figure 10:
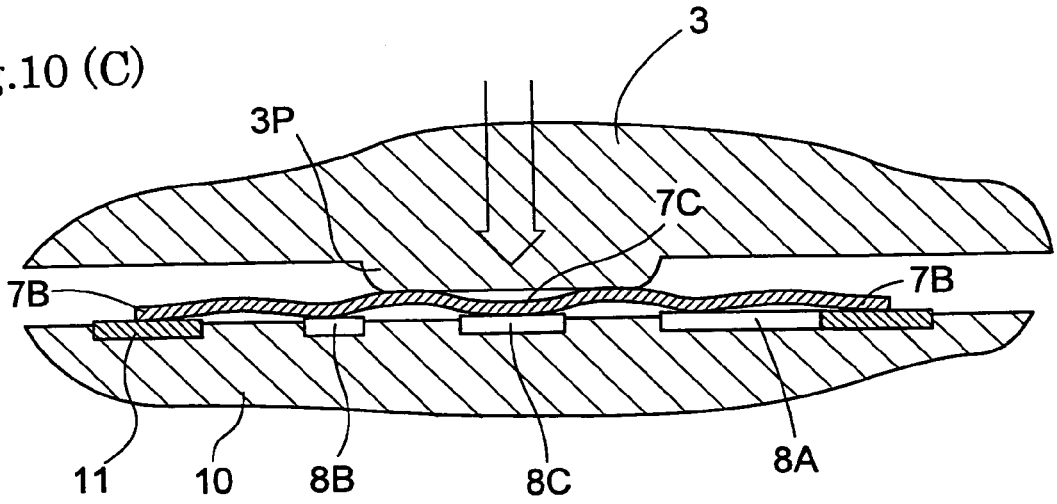

Incidentally, as shown in FIG. 8(*a*) and FIG. 10(*a*), there is provided a relative positional relationship such that when the operational button 2 is at the non-operated position U, the bottom face of a projecting portion 3P of the support member 3 and the center portion of the spring plate portion 7C may be apart from each other by a distance G along the Z axis.

Further, as shown in FIG. 8(*b*), when the operational button 2 has been depressed and a pressure exceeding a predetermined value is applied from the projecting portion 3P of the support member 3 to the spring plate portion 7C, this spring plate portion 7C and the connecting portions 7B almost entirely start their elastic deformation and as illustrated in FIG. 10(*b*), first the pair of connecting portions 7B will come into contact with the first electrode portion 8A and the second electrode portion 8B corresponding thereto, whereby an electric connection is established between this first electrode portion 8A and the second electrode portion 8B.

Subsequently, as the pressure from the projecting portion 3P of the support member 3 to the spring plate portion 7C is further increased, as illustrated in FIG. 10(*c*), while the pair of connecting portions 7B maintain the contacting condition with the first electrode portion 8A and the second electrode portion 8B, now, the center portion of the spring plate portion 7C comes into contact with the third electrode portion 8C, whereby an electric connection is established between the first electrode portion 8A and the third electrode portion 8C.

As described above, when the operational button 2 is depressed along the direction of the X axis, as described hereinbefore, the spring plate portion 7C approaches the PCB 10 with a change in posture for rendering the pair of connecting portions 7B into more parallel with the PCB 10. And, in the course of this approaching, there will take place an elastic deformation of partially reversing the bulging direction of the spring plate portion 7C. As a result, it is possible to obtain not only a reliable electric connection by maintaining the contact between the center portion of the spring plate portion 7C and the third electrode portion 8C with the elastic urging force, but also an appropriate click feel due to the reversal of the bulging direction. Incidentally, the establishment of electric connection is determined, based on the potential differences between the first electrode portion 8A, the second electrode portion 8B and the third electrode portion 8C.

(Mode of Surface Mounting)

Figure 1:
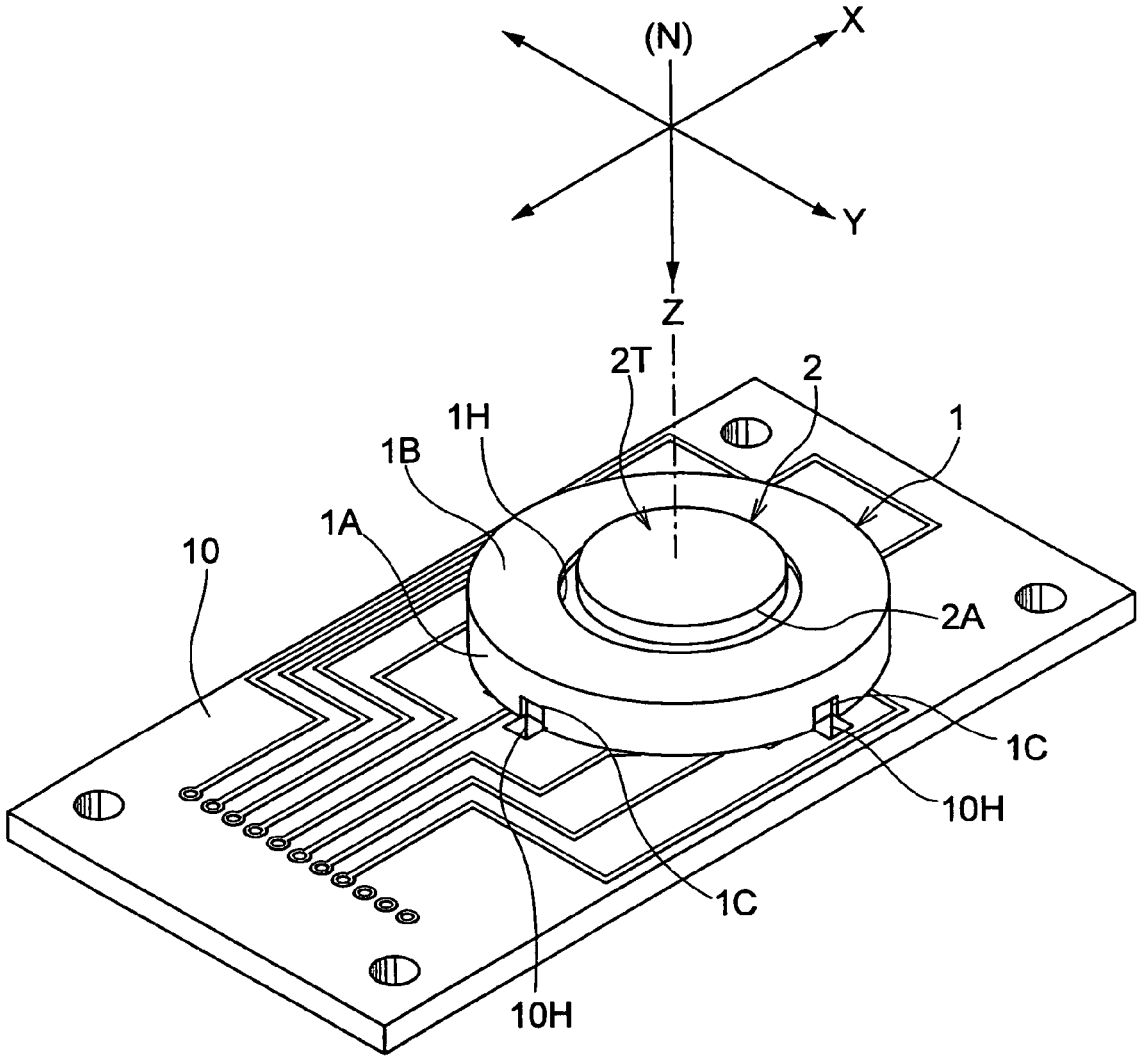
FIG. 1 is a perspective view showing a slide switch mounted on a printed circuit board.

When the slide switch of the invention is to be surface-mounted on the PCB 10, as shown in FIG. 1, the case 1 will be placed such that a plurality of holes 10H defined in the PCB 10 may be in opposition to a plurality of recesses 1C defined in the case 1. Next, by inserting positioning members (positioning means, not shown) into these holes 10H and the recesses 1C, the case 1 can be attached under a predetermined posture to the PCB 10. The above-described positioning means can be projecting pieces formed in one of the case 1 and the PCB 10 and recesses defined in the other for receiving the projecting pieces.

In addition to the ring-like electrode portion 11 and so on, the PCB 10 includes also eight independent electrode portions 12 formed by the circuit printing technique and a printed circuit for obtaining a potential difference of each independent electrode portion 12. Further, when the case 1 is fixed to the PCB 10, the electrode portions 4D of the eight movable contacts 4 come into contact with these independent electrode portions 12 to be electrically connected to each other respectively and at the same time, the contacting points 6B of the retaining member 6 are pressed against the ring-like electrode portion 11, thus establishing electric connection between the retaining member 6 and the ring-like electrode portion 11.

As described above, as the eight independent electrode portions 12 and the eight movable contacts 4D are maintained under the mutually pressed condition of these separate portions, the electric connection is obtained. However, alternatively, the electric connection can be maintained by permanently connecting these members by the soldering technique such as the well-known reflow soldering.

(Functions of Respective Portions)

Figure 9:
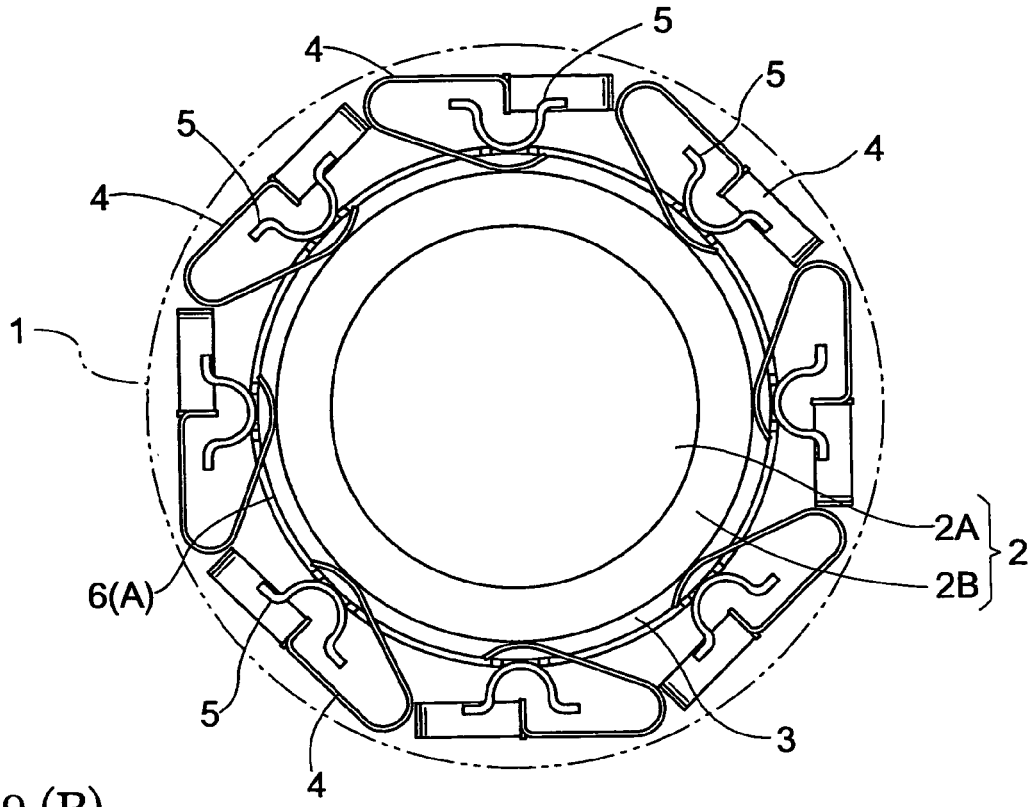
FIG. 9 is a plan view showing an operational member, the movable contacts and the fixed contacts under the non-operated state and a slid state thereof.
Figure 9:
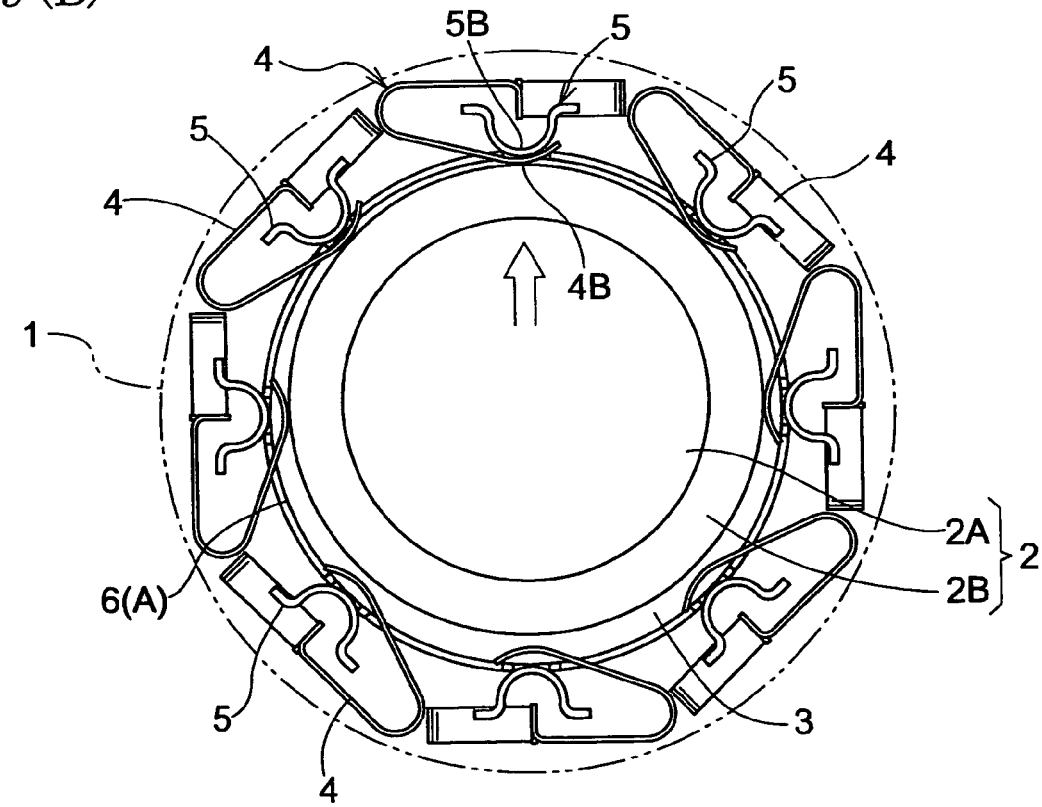

According to the slide switch having the above-described construction, when the operational button 2 is under the non-operated state, as illustrated in FIG. 9(*a*), under the non-operated state of the operational button 2, the operational button 2 is retained at the neutral position N within the virtual plane by the urging forces from the eight movable contacts 4 and also by the urging forces from the plurality of contacting pieces 6A together functioning as the urging mechanism B, the operational button 2 is maintained at the non-operated position U along the Z axis.

From the above-described condition, if a user now contacts his/her finger to the operational face 2T of the operational button 2 for operating this in the sliding direction (the directional along the virtual plane), then, as illustrated in FIG. 9(*b*), in response to the pressing force from the flange portion 2B of the operational button 2, the contacting portion 4B of the movable contact 4 is elastically deformed to come into contact with the contacting portion 5B of the fixed contact 5, thus rendering the particular movable contact 4 into the electrically conductive state thereof. Further, as the contacting face between operational button 2 and the support member 3 is located as the position not exposed to the outside, entrance of dust or the like into the gap therebetween can be restricted, so that a smooth operation can be maintained.

Incidentally, when the operational button 2 is slid, at least one pair of the eight movable contacts 4 and the eight fixed contacts 5 comes into contact with each other to reach the conductive condition, whereby the operated direction is electrically determined. However, with the slide switch of the present invention, the switch is constructed such that when the switch is slid in an intermediate direction between adjacent ones of the eight movable contacts 4, the two movable contacts 4 comes into contact with the corresponding fixed contacts 5 at one time, thus establishing electric connection at these two positions at a time.

With the above-described construction, if the operational button 2 is operated in such a manner as to move along the inner peripheral edge of the opening 1H of the case 1, while the first set of movable contact 4 and fixed contact 5 which first came into contact with each other is maintained, the adjacent second set of movable contact 4 and fixed contact 5 will come into contact with each other and after establishment of this latter contact, the foregoing contact between the first set of movable contact 4 and the fixed contact 5 will be released. That is to say, during the operation, there is no moment when all the movable contacts 4 and all the fixed contacts 5 are completely separated from each other. Therefore, there will develop no detection condition similar to that when operational button 2 has returned to the neutral position N, whereby detection error is avoided.

Further, from the condition of the operational button 2 being at the neutral position N, if this operational button 2 is now depressed along the direction of the Z axis, this operation is electrically detected by the operation detecting mechanism C. In this regard, according to the slide switch of the present invention, even if the operational button 2 is slid along the virtual plane, this will not move the support member 3, thus no change will occur in the relative positional relationship between the support member 3 and the operation detecting mechanism C along the sliding direction. As a result, even if the depressing operation of the operational button 2 along the Z axis direction is effected with the contact condition between the movable contact 4 and the fixed contact 5 being maintained, this depressing operation can be electrically detected by the operation detecting mechanism C.

Also, according to the slide switch of this invention, under the non-operated state of the operational button 2, with the operational button 2 and the support member 3 being superposed, the urging forces from the contacting pieces 6A of the retaining member 6 maintain the operational button 2 at the non-operated position U (see FIG. 8). And, as the depressing operation (operation in the Z axis direction) is effected as being guided by the retaining member 6, with the operational button 2 and the support member 3 being superposed, this operation can be effected smoothly and the operational button 2 can be maintained at the non-operated position U without using any additional means such as a coil spring.

Further, when the operational button 2 is located at this non-operated position U, there is formed a gap by a distance G between the projecting portion 3P of the support member 3 and the spring plate portion 7C. Hence, in comparison with a conventional construction in which these portions are in contact with each other, the above-described construction of the invention does not impair the smooth sliding operation feel. More particularly, in the case of the construction in which the contact between the projecting portion 3P of the support member 3 and the spring plate portion 7C is constantly maintained regardless of presence/absence of operation, when the operational button 2 is operated in the sliding direction, this operation will encounter resistance from the contact portion, thus being impaired in its feel. Moreover, if there occurs frictional wear at this contact portion, this will very likely result in deterioration in the operational feel in the depressing operation also.

In addition to the foregoing, the present invention may be embodied in manners described below. In the following discussion of various other embodiments of the invention, the members having the same functions as in the foregoing embodiment will be denoted with the same numerals or marks as the foregoing embodiment.

Figure 11:
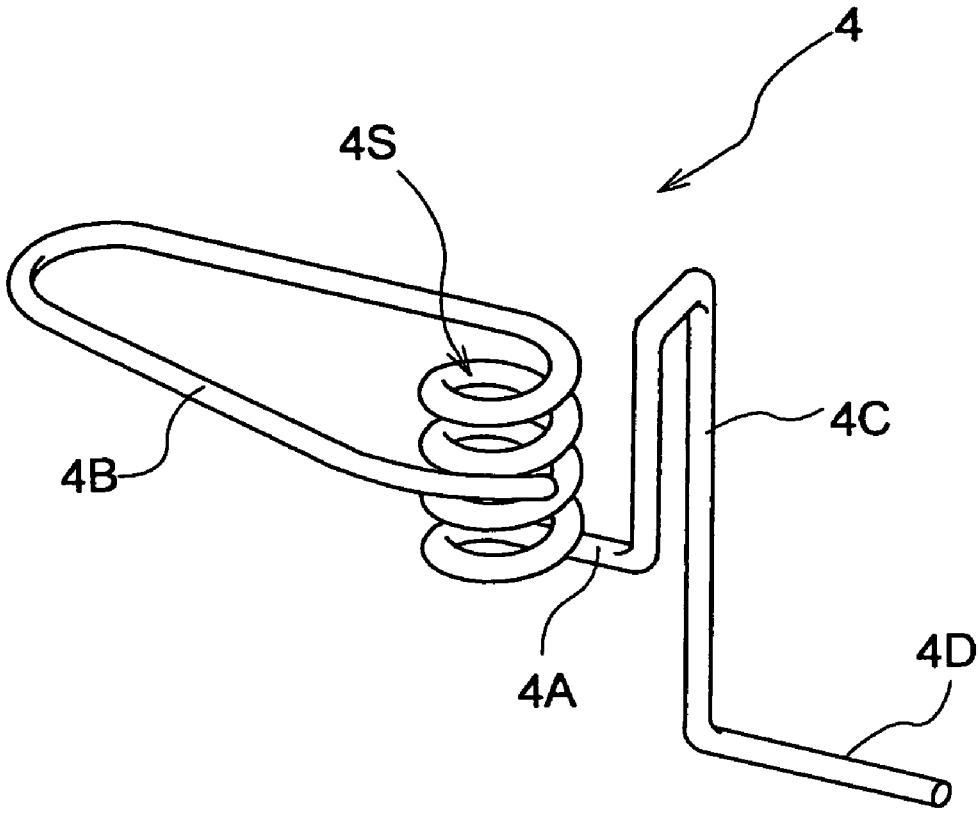
FIG. 11 is a perspective view showing construction of a movable contact in a further embodiment (a)

OTHER EMBODIMENTS (1) Instead of the movable contact 4 shown in FIG. 7 and others, as illustrated in FIG. 11, a copper alloy spring rod blank material may be bent and shaped. In the case of the movable contact 4 shown in FIG. 11, a base end portion 4A will be fitted and fixed within the first engaging groove D1 of the case and a contacting portion 4B at the free end will be bent and disposed at a position opposed to the outer peripheral portion of the flange portion 2B of the operational button 2. An electrode portion 4D is caused to project obliquely downward from the lower end of a vertical frame portion 4C extending continuously from the base end portion 4A, and between the base end portion 4A and the contacting portion 4B, a coil spring portion 4S is formed Thus, this movable contact 4 is constructed like a torsion spring. With this construction, even when this movable contact 4 is used with a large deformation in the contacting portion 4B thereof, the coil spring portion 4S can readily deformed elastically. And, the durability of the contact can be improved also. Incidentally, the spring rod blank material used herein can be stainless steel rod or wire or a piano wire with gold plating.

Figure 12:
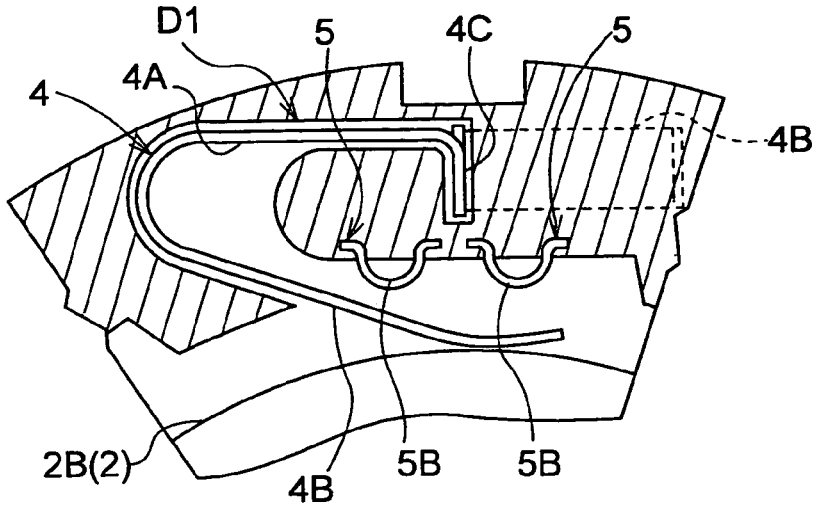
FIG. 12 is a section view showing conducting state between a movable contact and a fixed contact in a still further embodiment (b)
Figure 12:
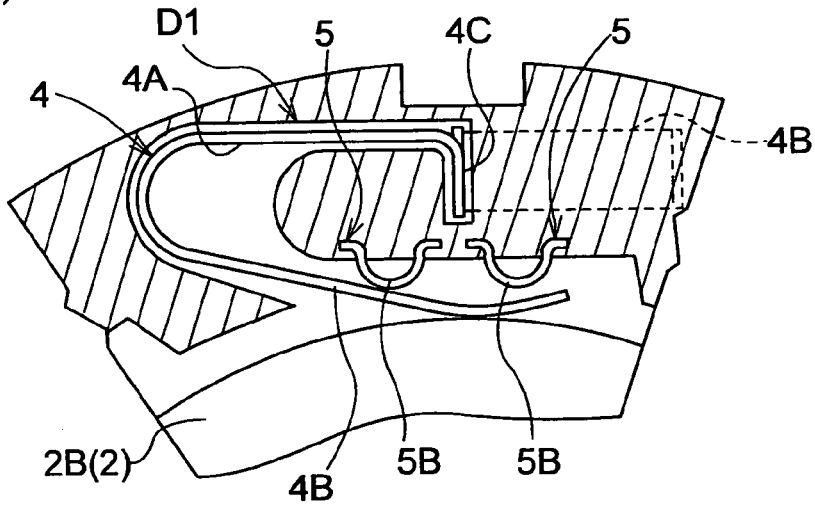
Figure 12:
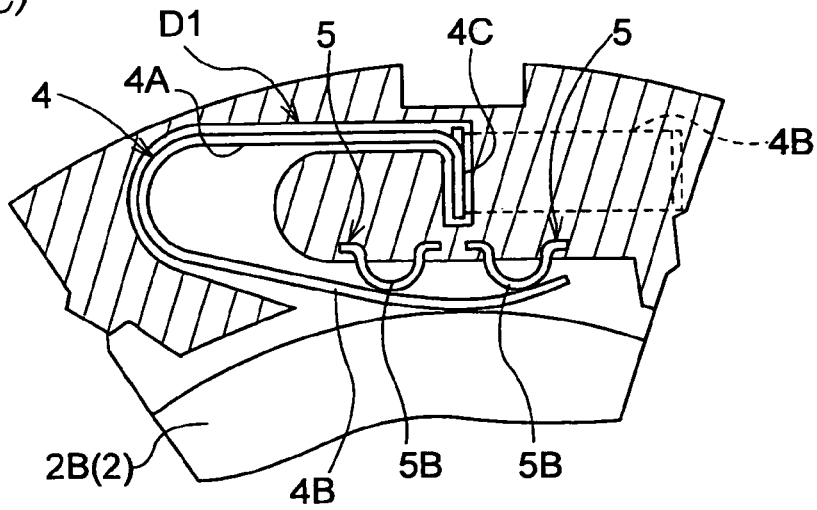

(2) As illustrated in FIG. 12(*a*), for one movable contact 4, two electrically independent fixed contacts 5 may be provided. With this construction, when a predetermined pressure is applied from the operational button 2 to the movable contact 4, as illustrated in (b), the elastically deformed movable contact 4 will come into conductive contact only with the contacting portion 5B of the first fixed contact 5B. As the pressure is further increased, as illustrated in (c), the movable contact 4 is further elastically deformed to come into conductive contact also with the contacting point 5B of the second fixed contact 5 in addition to the contacting point 5B of the first contact 5. With this construction, it becomes possible to detect operated positions in two steps in the same direction according to the operated amount of the operational button 2. Needless to say, three or more electrically independent fixed contacts 5 may be provided for one movable contact 4.

Figure 13:
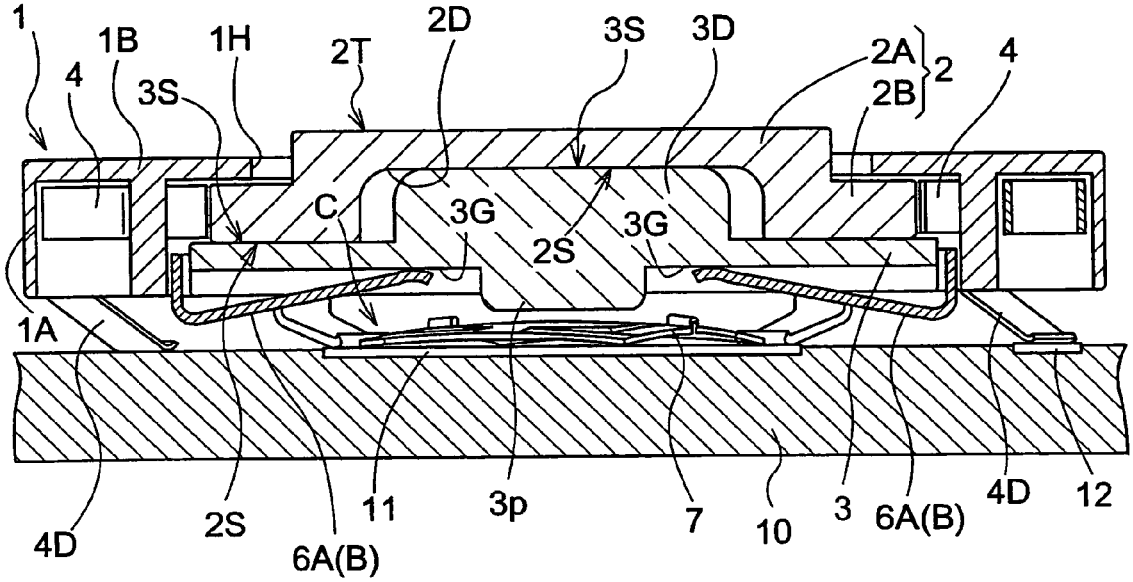
FIG. 13 is a section view showing a slide switch relating to a still further embodiment (c).

(3) As shown in FIG. 13, in the lower side of the operational button 2, a recess 2D may be formed and a projecting portion 3D to be fitted within this recess 2D may be formed in the upper face of the support member 3. In the case of this construction, the lower face of the recess 2D constitutes the sliding face 2S and the upper face of the projecting portion 3D constitutes the supporting face 3S. Further, when this construction is employed, through appropriate various setting of the relationship between the diameter of the recess 2D and the diameter of the projecting portion 3D, it is possible to set to a desired value the relative sliding amount between the operational button 2 and the support member 3. Or, conversely from the construction of FIG. 13, as this fitting construction, the projecting portion may be formed in the lower face of the operational button 2 whereas the recess may be formed in the upper face of the support member 3.

(4) More than eight movable contacts and fixed contacts may be provided respectively, so as to enable detection of more than eight operational directions.

The invention claimed is:

1. A slide switch comprising:

an operational member slidable in a direction along a virtual plane;

a plurality of movable contacts arranged at positions surrounding the operational member;

a plurality of fixed contacts provided in correspondence with the movable contacts so as to render at least one of the movable contacts into a conductive state in association with a sliding operation of the operational member;

a support member for slidably supporting said operational member via a sliding face provided on the back face of the operational member;

a guide mechanism which allows integral displacement of said operational member and said support member, in response to a depressing operational force to said operational member in a direction normal to said virtual plane; and an urging mechanism operable to return said support member toward said operational member in the absence of said depressing operational force.

2. The slide switch according to claim 1, wherein said guide mechanism includes a retaining member for electrically integrating and retaining the plurality of fixed contacts, and said retaining member includes, at an opposite end thereof away from the operational member, a contacting piece for coming into contact with said support member for applying an urging force thereof, said contacting piece constituting said urging mechanism.

3. The slide switch according to claim 1, wherein there is provided an operation detecting mechanism which reaches a detecting condition in response to a pressure applied from said support member in the course of the depressing operation of said operational member, and a gap is formed between said support member and said operation detecting mechanism in the absence of the depressing operation of the operational member.

4. The slide switch according to claim 3, wherein said operation detecting mechanism includes a conductive spring plate portion and a plurality of electrode portions which come into contact with said spring plate portion in accordance with a deformation amount corresponding to the pressure from said support member.

5. The slide switch according to claim 1, wherein there is provided a case member for slidably accommodating said operational member therein, and said movable contact includes a base end portion supported to said case member and a contacting portion in the form of a plate spring disposed in opposition to said fixed contact.

6. The slide switch according to claim 5, wherein a coil spring portion is formed between said base end portion and said contacting portion.

7. The slide switch according to claim 1, wherein for each said movable contact, there are provided a plurality of said fixed contacts electrically insulated from each other, and in accordance with increase in the sliding operation amount of said operational member, there occurs corresponding increase in the number of the fixed contacts which come into contact with the movable contact.

* * * * *